US005483045A

United States Patent [19]

Gerling

[11] Patent Number: 5,483,045

[45] Date of Patent: Jan. 9, 1996

[54] MICROWAVE POWER SYSTEM AND METHOD WITH EXPOSURE PROTECTION

[75] Inventor: John E. Gerling, Medford, Oreg.

[73] Assignee: Electric Power Research Institute, Palo Alto, Calif.

[21] Appl. No.: 257,067

[22] Filed: Jun. 9, 1994

[51] Int. Cl.[6] ..... H05B 6/68

[52] U.S. Cl. ..... 219/722; 219/723; 34/260; 315/106; 361/104

[58] Field of Search ..... 219/723, 722, 219/724, 721, 716; 34/259, 260, 261; 200/50 C; 361/93, 102, 104; 315/105, 106

[56] References Cited

U.S. PATENT DOCUMENTS

| | | | |
|---|---|---|---|
| 4,096,370 | 6/1978 | Duncan | 219/723 |
| 4,663,508 | 5/1987 | Ishimura et al. | 219/723 |
| 4,672,160 | 6/1987 | Katoh | 219/724 |
| 4,833,284 | 5/1989 | Park . | |
| 4,868,508 | 9/1989 | Ohishi . | |
| 4,868,509 | 9/1989 | Ury . | |
| 4,939,331 | 7/1990 | Berggren et al. . | |
| 4,949,233 | 8/1990 | Braunisch et al. . | |
| 5,132,503 | 7/1992 | Lee . | |
| 5,258,595 | 11/1993 | Tanaka | 219/723 |

FOREIGN PATENT DOCUMENTS

| | | | |
|---|---|---|---|
| 56-18222 | 2/1981 | Japan | 219/722 |
| 2-121293 | 5/1990 | Japan | 219/723 |
| 3-175215 | 7/1991 | Japan | 219/722 |
| 2039175 | 7/1980 | United Kingdom | 219/722 |

*Primary Examiner*—Philip H. Leung
*Attorney, Agent, or Firm*—Flehr, Hohbach, Test, Albritton & Herbert

[57] ABSTRACT

System and method for interrupting the delivery of microwave power to a microwave cavity when a door to the cavity is opened and an interlock switch fails to operate. A switch actuated by movement of the door applies an overload current to an overload protector in the filament circuit of the generator which supplies microwave power to the cavity, thereby interrupting the filament current and shutting down the generator.

7 Claims, 1 Drawing Sheet

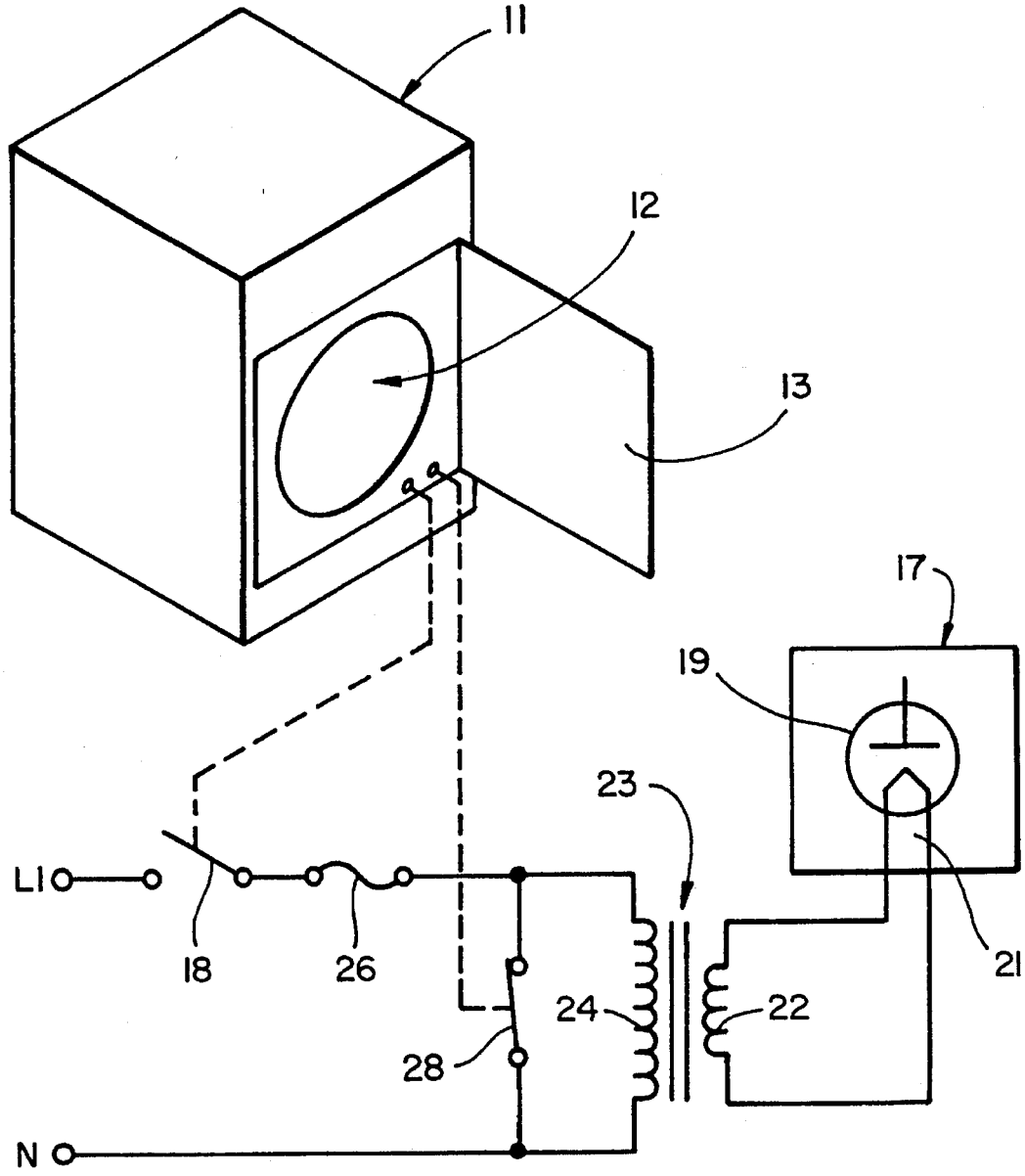
11
12
13
17
19
23
L1
18
26
24
22
21
28
N

MICROWAVE POWER SYSTEM AND METHOD WITH EXPOSURE PROTECTION

This invention pertains generally to microwave power supplies and, more particularly, to a system and method for interrupting the delivery of microwave power to avoid harmful exposure to such power.

The Center for Devices and Radiological Health (CDRH) requires the use of a so-called monitor switch in microwave applications to prevent exposure to microwave power. Such switches supplement the safety interlock switches which microwave appliances normally have for interrupting the generation of microwave power when the door of the appliance is open. The monitor switch functions by causing an overcurrent condition in the line fuse of the appliance to interrupt the operating power in the event that an interlock switch fails to operate when the door is opened.

In microwave ovens, the line current is relatively small (less than 15 amperes), and can be handled by the contacts of a relatively small monitor switch. For other appliances, such as microwave clothes dryers, where the operating current is higher (typically, 30 amperes, or more), the normal monitor switch cannot handle the overload current without being damaged.

It is in general an object of the invention to provide a new and improved system and method for interrupting the generation of microwave power when the access door to a microwave cavity is open.

Another object of the invention is to provide a system and method of the above character which overcome the limitations and disadvantages of the so-called monitor switches of the prior art.

These and other objects are achieved in accordance with the invention by providing a monitor switch which functions in conjunction with an overload protector in the filament circuit of a microwave generator. When the access door to the microwave cavity is opened and an interlock switch fails to interrupt the power to the generator, the monitor switch applies an overload current to the overload protector in the filament circuit, thereby interrupting the filament current and shutting down the generator.

The single FIGURE of drawings is a schematic diagram of one embodiment of a microwave power system incorporating the invention.

In the drawing, the invention is illustrated in connection with a microwave clothes dryer 11 which includes a microwave cavity or chamber 12 for receiving the clothes to be dried. Access to the cavity is provided by a door 13 which has conventional seals (not shown) for preventing leakage of microwave energy from the cavity.

Microwave power for drying clothes is supplied to the cavity from a microwave generator 17. The generator is of conventional design, and a safety interlock switch 18 is actuated by the cavity door 13 to shut down the generator when the door is open. This switch is connected in series with the line conductor L1 of an a.c. source and is normally closed in that it is in a closed or conductive state for supplying power to the generator when the door is closed.

The generator includes a magnetron tube 19 with a filament circuit 21 connected to the secondary winding 22 of a filament transformer 23. This transformer receives power from the a.c. source, with one end of the primary winding 24 being connected to line conductor L1 through interlock switch 18 and the other end of the primary winding being connected to the neutral conductor N. An overcurrent protector comprising a fuse 26 is connected between the interlock switch and the primary winding to protect the magnetron tube from an overcurrent condition in the filament circuit.

A monitor switch 28 is connected across the primary winding of the filament transformer. This switch is also actuated by the cavity door 13 and is a normally open switch in that it is in an open or nonconductive state when the door is closed. The two switches are arranged such that the interlock switch opens before the monitor switch closes when the door is opened, and the monitor switch opens before the interlock switch closes when the door is closed. This sequencing can be provided simply by positioning the monitor switch closer to hinge side of the door than the interlock switch so that the interlock switch will be actuated first as the door swings open and last as the door swings closed.

The location of the monitor switch in the filament circuit is advantageous in that the current levels are lower in that circuit than in the plate circuit or other parts of a microwave system, which means the small and less expensive switches can be used. In a typical microwave clothes dryer, for example, the current on the primary side of the filament transformer is on the order of 5 amperes or less, whereas the current in the plate circuit can be as high as 30 amperes, or more.

Operation and use of the system, and therein the method of the invention, is as follows. During normal operation, when the door to the cavity is closed, power is supplied to the generator through the interlock switch. If the door is opened while the generator is operating, the opening of the interlock switch will interrupt the power to the generator, turning the generator off and interrupting the delivery of microwave power to the cavity. Under normal conditions, the monitor switch has no effect on the operation of the system, since it closes after the interlock switch has opened and opens before the interlock switch closes.

If, however, the interlock switch should malfunction and fail to interrupt the current when the door is opened, the closing of the monitor switch will connect the fuse directly between the line and neutral conductors, applying the full line voltage to the fuse. The resulting overcurrent will cause the fuse to blow, interrupting the filament current to the magnetron tube. Without filament current, the magnetron tube will generate no power since a cold filament will not produce the electrons which are required to operate the tube.

The invention has a number of important features and advantages. It provides a reliable and effective way of turning off the microwave power so that no one will be exposed to microwave radiation if a safety interlock switch should fail to operate when the cavity door is opened. It operates in the filament circuit where the current levels are substantially lower than they are, for example, in the plate circuit of a microwave system. This permits the use of smaller and substantially less expensive switches than might otherwise be required in clothes dryers and other high powered microwave devices.

It is apparent from the foregoing that a new and improved system and method for interrupting the generation of microwave power been provided. While only certain presently preferred embodiments have been described in detail, as will be apparent to those familiar with the art, certain changes and modifications can be made without departing from the scope of the invention as defined by the following claims.

I claim:

1. In a system for supplying microwave power to a cavity having a closure which can be opened to provide access to the interior of the cavity: a microwave generator having a separate low power filament circuit for delivering only filament current for the generator, an overcurrent protector through which only filament circuit current normally passes for interrupting delivery of filament current to the generator in the event that the current through the protector exceeds a predetermined level, and means responsive to opening of the closure for applying a current in excess of the predetermined level to the overcurrent protector to cause an interruption in the delivery of microwave power to the cavity.

2. In a method of supplying microwave power to a cavity having a closure which can be opened to provide access to the interior of the cavity, the steps of: generating microwave power for the cavity with a generator having a separate low power filament circuit with an overcurrent protector through which only filament circuit current normally passes for interrupting delivery of filament current to the generator in the event that the current through the protector exceeds a predetermined level, and applying a current in excess of the predetermined level to the overcurrent protector to cause an interruption in the delivery of microwave power to the cavity in response to an opening of the closure.

3. In a microwave appliance: a cavity, a door movable between open and closed positions for providing access to the cavity, means including a magnetron tube for delivering microwave power to the cavity, a separate filament circuit for supplying only filament current to the magnetron tube, an overcurrent protector in the filament circuit for interrupting the application of filament current to the magnetron tube in the event that the current through the protector exceeds a predetermined level, means for determining when the cavity door is in an open position, and means responsive to the determining means for applying a current in excess of the predetermined level to the overcurrent protector to cause an interruption in the delivery of microwave power to the cavity when the door is in the open position.

4. The microwave appliance of claim 3 wherein the overcurrent protector is a fuse.

5. In a method of generating microwave power for application to a cavity having an access door movable between open and closed positions, the steps of: applying filament current and operating power to a magnetron tube to generate microwave power, monitoring the filament current but not the operating power with an overcurrent detector adapted to interrupt the application of the current in the event that the current exceeds a predetermined level, monitoring the position of the door, and applying a current in excess of the predetermined level to the overcurrent protector to cause an interruption in the generation of microwave power when the door is in an open position.

6. In a microwave appliance: a cavity, a door movable between open and closed positions for providing access to the cavity, means including a magnetron tube for delivering microwave power to the cavity, means for supplying operating power to the magnetron tube, a filament circuit separate from the means for supplying operating power for applying only filament current to the magnetron tube, an interlock switch in the filament circuit for interrupting the current in the filament circuit when the door is open, an overcurrent protector in the filament circuit for interrupting the application of filament current to the magnetron tube in the event that the current through the protector exceeds a predetermined level, and a switch responsive to movement of the door to an open position for applying to the overcurrent protector a current in excess of the predetermined level but substantially lower than that associated with the operating power for the magnetron tube in the event that the interlock switch fails to interrupt the power.

7. In a microwave appliance: a cavity, a door movable between open and closed positions for providing access to the cavity, means including a magnetron tube for delivering microwave power to the cavity, a normally closed interlock switch adapted for opening when the door is moved to an open position, a filament transformer having a primary winding connected for receiving current through the interlock switch and a single secondary winding for supplying only filament power to the magnetron tube, a fuse connected between the interlock switch and the primary winding for interrupting the current to the primary winding in the event that the current exceeds a predetermined level, and a normally open monitor switch connected across the primary winding and adapted to close after the interlock switch has opened, the closing of the monitor switch causing a current in excess of the predetermined level but substantially less than the operating current for the magnetron tube to be applied to the fuse in the event that the interlock switch fails to interrupt the current to the primary winding.

* * * * *